US009039461B2

(12) United States Patent
Wan et al.

(10) Patent No.: US 9,039,461 B2
(45) Date of Patent: May 26, 2015

(54) ELECTRICAL CONNECTOR

(71) Applicant: ADVANCED-CONNECTEK INC., Taipei (TW)

(72) Inventors: Wei Wan, Taipei (TW); Shu-Lin Duan, Taipei (TW); Hua-Yan Wu, Taipei (TW); Xiao-Juan Qi, Taipei (TW)

(73) Assignee: ADVANCED-CONNECTEK INC., Taipei (TW)

( * ) Notice: Subject to any disclaimer, the term of this patent is extended or adjusted under 35 U.S.C. 154(b) by 71 days.

(21) Appl. No.: 13/938,556

(22) Filed: Jul. 10, 2013

(65) Prior Publication Data

US 2014/0017959 A1 Jan. 16, 2014

(30) Foreign Application Priority Data

Jul. 13, 2012 (CN) ..... 2012 1 0242137

(51) Int. Cl.

| | |
|---|---|
| ***H01R 13/04*** | (2006.01) |
| ***H01R 24/62*** | (2011.01) |
| *H01R 107/00* | (2006.01) |

(52) U.S. Cl.

CPC ..... *H01R 13/04* (2013.01); *H01R 24/62* (2013.01); *H01R 2107/00* (2013.01)

(58) Field of Classification Search

USPC ..... 439/733.1, 639, 79, 638

See application file for complete search history.

(56) References Cited

U.S. PATENT DOCUMENTS

| | | | | |
|---|---|---|---|---|
| 5,309,316 | A * | 5/1994 | Yagi et al. | 361/749 |
| 6,619,968 | B2 * | 9/2003 | Xu | 439/79 |
| 6,736,676 | B2 * | 5/2004 | Zhang et al. | 439/607.22 |
| 7,591,683 | B2 * | 9/2009 | Zhang et al. | 439/638 |
| 7,748,999 | B1 * | 7/2010 | Sun et al. | 439/79 |
| 8,011,979 | B1 * | 9/2011 | Lai | 439/855 |
| 8,210,880 | B2 * | 7/2012 | Lee et al. | 439/639 |
| 2002/0111068 | A1 * | 8/2002 | Cohen et al. | 439/608 |

* cited by examiner

*Primary Examiner* — Alexander Gilman
(74) *Attorney, Agent, or Firm* — Rabin & Berdo, P.C.

(57) ABSTRACT

An electrical connector includes a metal body and an insulation body received in the metal body and having therein first terminals and second terminals. Each first and second terminal has a connecting segment extending outward and a bent formed on a distal end of the connecting segment.

6 Claims, 7 Drawing Sheets

ELECTRICAL CONNECTOR

CROSS-REFERENCES TO RELATED APPLICATIONS

This non-provisional application claims priority under 35 U.S.C. §119(a) on Patent Application No. 201210242137.9 filed in China, P.R.C. on 2012 Jul. 13, the entire contents of which are hereby incorporated by reference.

BACKGROUND

1. Technical Field

The invention relates to an electrical connector and, more particularly, to an electrical connector having fewer components and more integrated elements to simplify the overall structure and lower the manufacture cost.

2. Related Art

Nowadays, as the advance of modern technology and the increasingly increased demands for high quality domestic electrical appliance, electrical devices for digital music and/or digital films are constantly improved to provide higher and higher quality to the listeners and/or viewers.

HDMI (high definition multimedia interface) is a kind of electrical connector aimed at providing high quality multimedia audio/video performance, which supports 1920×1080P HD digital signal as well as Dolby Digit/DTS digital audio format. In addition to the transmission of audio/video signals, HDMI can also transmit up to eight (8) different tracks of audio signals. As a result of all these advantages, a HDMI connector is now standard equipment equipped with audio/video devices.

The currently available components of the HDMI are all assembled individually, especially the terminals. When the HDMI connector is being made, the terminals are assembled in parallel and bent twice and then cut. The process for making terminals are complex and involves a lot of different assembly processes, which increases the manufacture cost and qualification thereof is not able to control.

SUMMARY

The primary objective of the present invention is to provide an electrical connector which involves fewer components and less cost.

In order to accomplish the aforementioned objective, the electrical connector of the preferred embodiment of the present invention includes:

a metal shell; and insulation housing received in the metal shell and having first terminals or second terminals which respectively has a first bent portion or a second bent portion extending from a corresponding body portion thereof, wherein the first terminals and the second terminals are connected via a connecting segment.

In a preferred embodiment of the present invention, the metal shell has a receiving cavity and the insulation housing has a tongue portion extending into the receiving cavity of the metal shell.

In still another objective of the preferred embodiment of the present invention, each of the first terminals or the second terminals respectively has a first contact portion or a second contact portion wherein the first contact portions and the second contact portions are arranged in a transverse row relative to the insulation housing and each of the first contact portion is interleaved between two second contact portions.

In still another objective of the preferred embodiment of the present invention, the electrical connector of the present invention further has a casing assembled together with the metal shell and the insulation housing.

Due to the integral formation of the terminals and characters thereof such as the first bent and second bent portions, the first and second contact portions and the connecting segment, each of the terminals is able to be made via molding process and then is mounted onto the insulation housing via insert-molding process, which greatly reduces assembly process as well as manufacture cost.

DETAILED DESCRIPTION OF THE INVENTION

Figure 1:
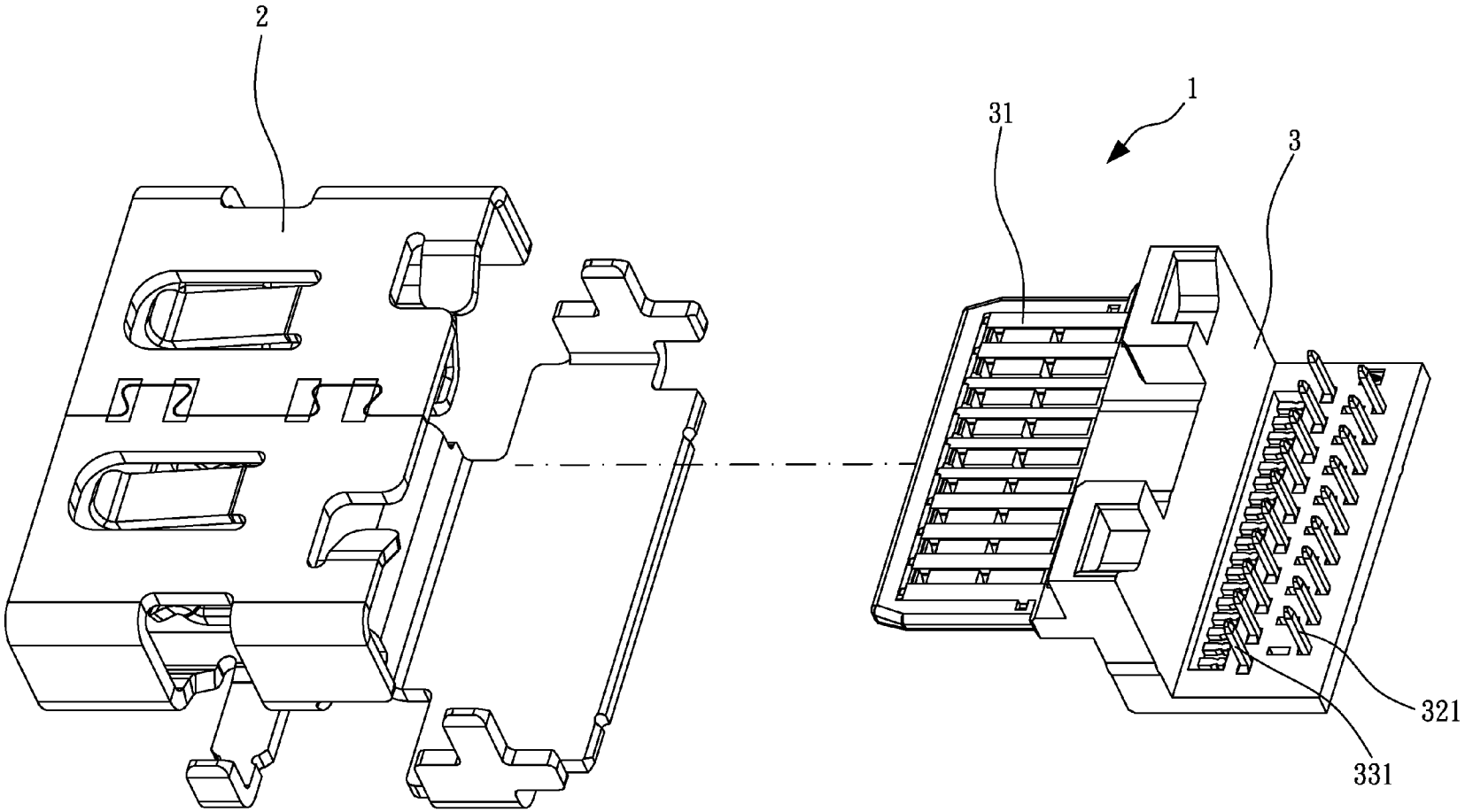
FIG. 1 is an exploded perspective view of the electrical connector of the present invention.
Figure 2:
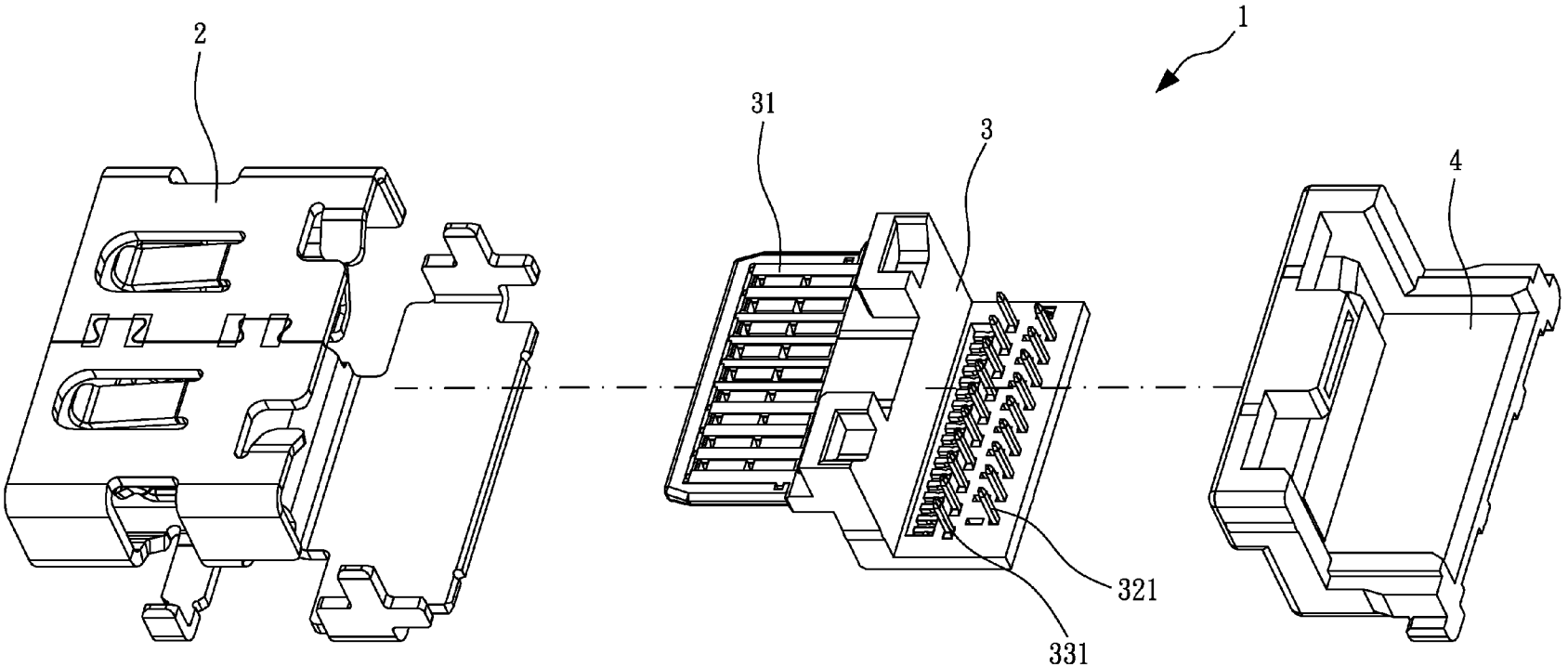
FIG. 2 is an exploded perspective view of another electrical connector of the present invention.
Figure 3:
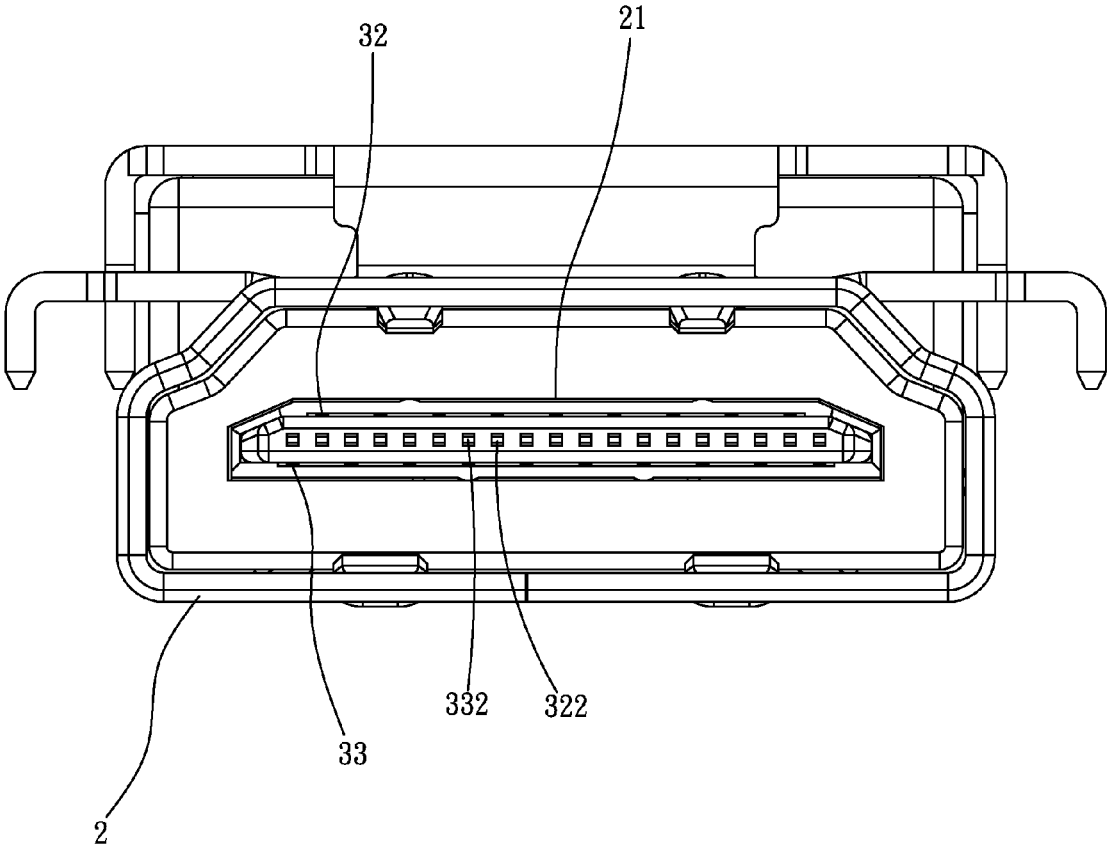
FIG. 3 is an end view showing the assembled electrical connector of the present invention.
Figure 4:
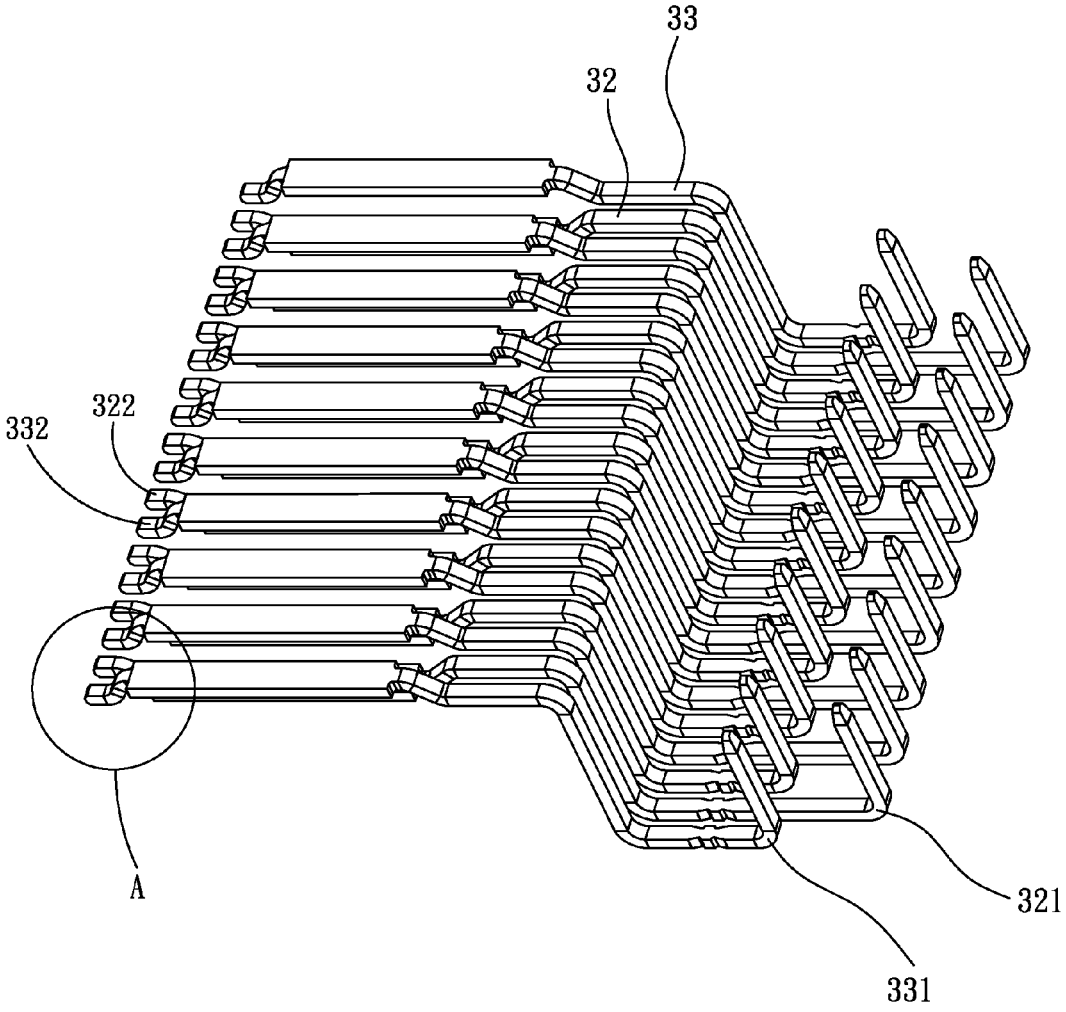
FIG. 4 is a perspective view showing the structure of the terminals.
Figure 4A:
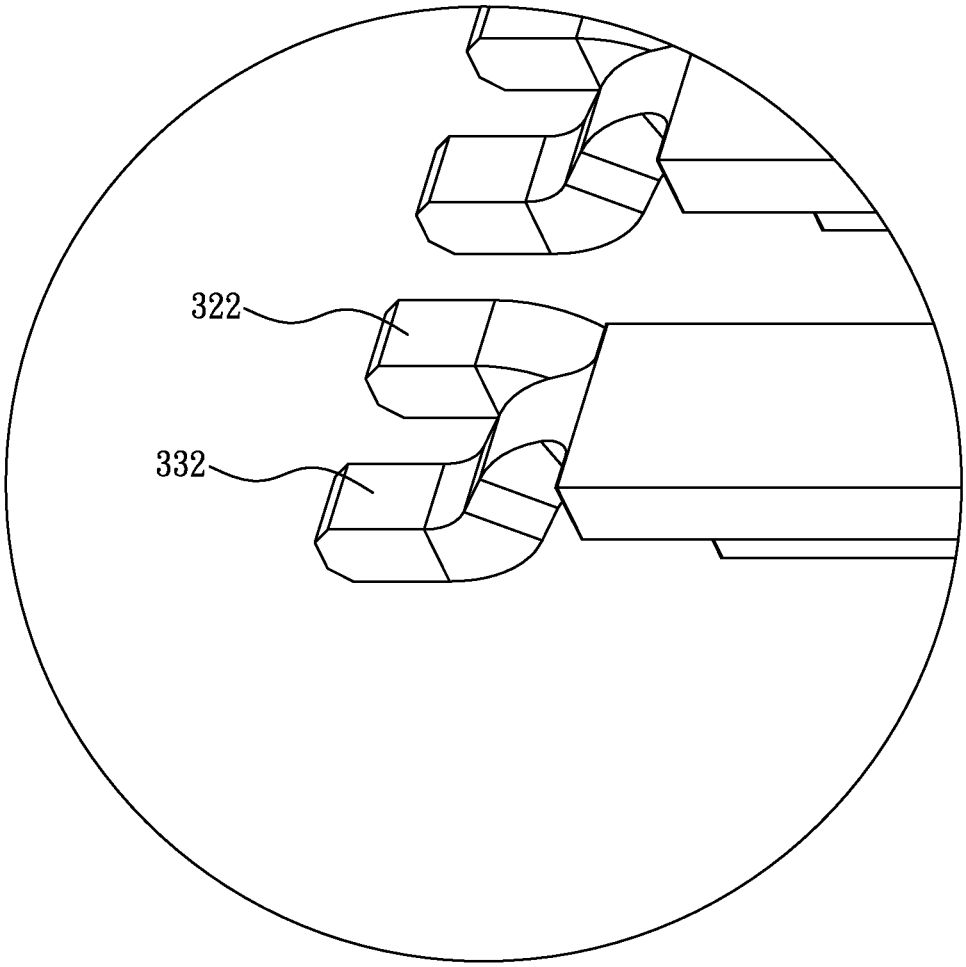
FIG. 4A is an enlarged perspective view showing the structure of the distal end of each of the terminals.

With reference to FIGS. 1, 2 and 3, the electrical connector 1 constructed in accordance with the preferred embodiment of the present invention includes a metal shell 2 defining a receiving cavity 21 formed inside the metal shell 2 and an insulation housing 3 having a tongue portion 31 integrally formed with the base portion of the insulation housing 3. The tongue portion 31 is received in the receiving cavity 21 of the metal shell 2. The insulation housing 3 further has first terminals 32 and second terminals 33 retained therein. Each of the first terminals 32 and the second terminals 33 respectively has a first bend portion 321, and a second bend portion 331 integrally extending from a corresponding body portion thereof. Each of the first terminals 32 and the second terminals 33 are connected via a connecting segment 34 which is close to the corresponding first bend portion 321 and the corresponding second bend portion 331. The connecting segment 34 is protruded from the lateral sides of each of the first terminals 32 and the second terminals 33 so as to form criss-cross patterns. Each of first contact portions 322 or second contact portions 332 is formed on a distal end of the respective first terminal 32 or the respective second terminal 33, and are formed oppositely to the first bend portion 321, and the second bend portion 331, as shown in FIG. 4 and FIG. 4A. The first contact portions 322 are arranged in a transverse row relative to the insulation housing 3. Each of the first contact portion 322 is interleaved between two second contact portions 332.

The first contact portions 322 and the second contact portions 332 are embedded in the insulation housing 3 to avoid deformation of the first contact portions 322 as well as the second contact portions 332.

Figure 5:
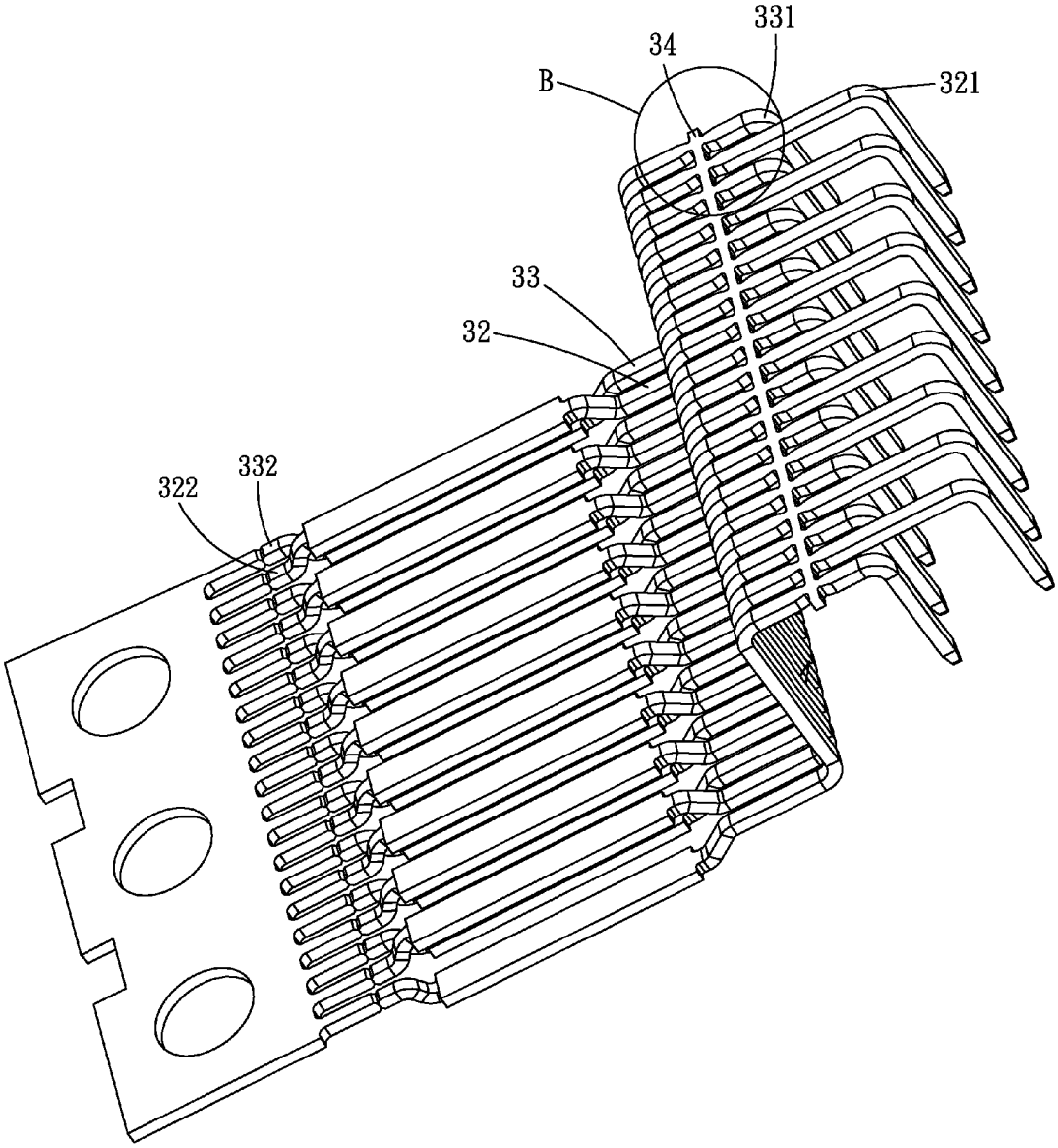
FIG. 5 is a perspective view of the terminals of the present invention.
Figure 5A:
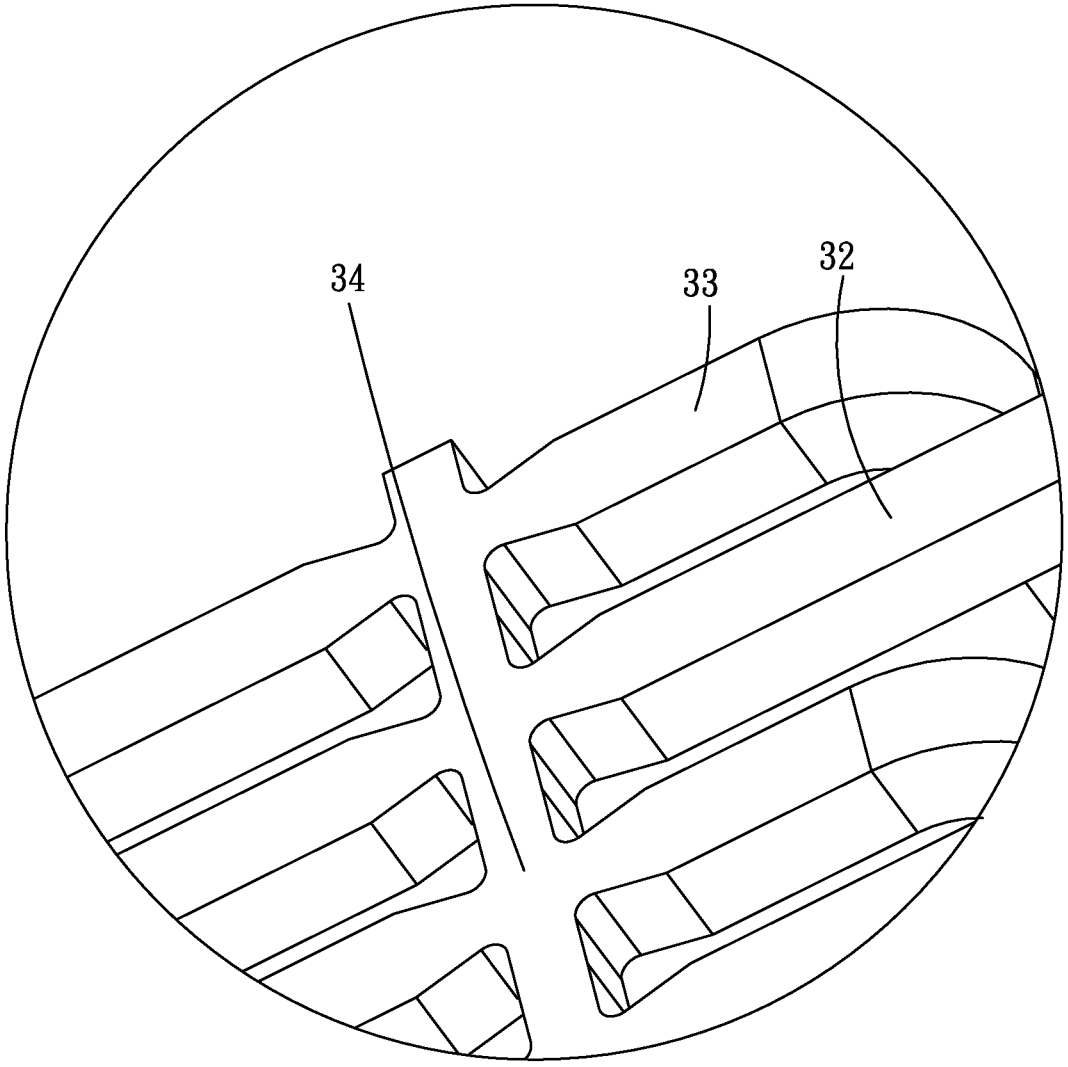
FIG. 5A is an enlarged perspective view showing the terminals and a connecting segment of the present invention.

With reference to FIG. 5 and FIG. 5A, it is to be noted that when the electrical connector is being made, the formation of the first terminals 32 and the second terminals 33 are made by fixing the connecting segment 34 and then a molding process is adopted. After that, an insert molding process is adopted to securely mount the first terminals 32 and the second terminals 33 onto the insulation housing 3 to effectively reduce component as well as the manufacture cost. Here, the connecting segment 34 is substantially perpendicular to the first terminals 32 and the second terminals 33 so as to connect with the first terminals 32 or the second terminals 33; and, the connecting segment 34 is extruded out of the second terminals 33. That is to say, a first inclined angle defined between the first terminals 32 and the connecting segment 34 is about 90 degrees, for example, the first inclined angle is defined between 85 degrees to 95 degrees; a second inclined angle defined between the second terminals 33 and the connecting segment is about 90 degrees, for example, the second inclined angle is defined between 85 degrees to 95 degrees.

It is noted from the description that the structure of the present invention has the following advantages:

The first terminals 32 and the second terminals 33 are made via molding process and then an insert molding process is adopted to securely mount the first terminals 32 and the second terminals 33 on the insulation housing to finish the process of semi-products, which greatly reduces the number of components.

When insert molding is being processed, the first contact portions 322 and the second contact portions 332 are buried in plastic to avoid unbalanced terminals.

A casing may also be added to the finished product and can be tailored to meet different requirements to enhance compatibility with others.

It is to be noted that although the preferred embodiment of the present invention has been described, other modifications, alterations or minor change to the structure should still be within the scope defined in the claims. As those skilled in the art will readily observe that numerous modifications and alterations of the device and method may be made while retaining the teachings of the invention.

What is claimed is:

1. An electrical connector comprising:

a metal shell;

an insulation housing received in the metal shell;

first terminals and second terminals aligned alternatively in the insulation housing, each of the first terminals having a first contact portion and a first bend portion formed on opposite distal ends from each other, each of the second terminals having a second contact portion and a second bend portion formed on opposite distal ends from each other, the first contact portion and the second contact portions being interleaved relative to each other; and a connecting segment connecting the first terminals to the second terminals, after the first and second terminals are connected to each other with the connecting segment then the first and second terminals and the connecting segment are mounted onto the insulation housing via an insert molding process so that the first contact portions and the second contact portions are embedded in the insulation housing, and the connecting segment being adjacent to the first and second bend portions and substantially perpendicular to the first terminals and the second terminals.

2. The electrical connector as claimed in claim 1, wherein the metal shell defines a receiving cavity.

3. The electrical connector as claimed in claim 2, wherein the insulation housing has a tongue portion for being received in the receiving cavity.

4. The electrical connector as claimed in claim 1 further comprising a casing to be assembled with the metal shell and the insulation housing.

5. The electrical connector as claimed in claim 1, wherein the electrical connector is a HDMI electrical connector.

6. A method of manufacturing an electrical connector, comprising:

aligning alternatively first terminals and second terminals to be embedded in an insulation housing, each of the first terminals having a first contact portion and a first bend portion formed on opposite distal ends from each other, each of the second terminals having a second contact portion and a second bend portion formed on opposite distal ends from each other, the first contact portions and the second contact portions being interleaved relative to each other in a side view;

connecting the first terminals to the second terminals with a connecting segment, the connecting segment being adjacent to the first and second bend portions and substantially perpendicular to the first terminals and the second terminals;

after the connecting, mounting the first and second terminals and the connecting segment onto the insulation housing via insert molding process so that the first and second terminals are embedded in the insulation housing; and inserting the insulation housing into a metal shell.

* * * * *